US011752512B2

(12) United States Patent
Rueschhoff et al.

(10) Patent No.: US 11,752,512 B2
(45) Date of Patent: Sep. 12, 2023

(54) DISPENSING APPARATUS AND METHOD

(71) Applicant: DAP Products, Inc., Baltimore, MD (US)

(72) Inventors: Ken Rueschhoff, Wildwood, MO (US); Kevin Corcoran, St. Louis, MO (US); Jason Wirth, Baltimore, MD (US)

(73) Assignee: DAP Products, Inc., Baltimore, MD (US)

( * ) Notice: Subject to any disclaimer, the term of this patent is extended or adjusted under 35 U.S.C. 154(b) by 227 days.

(21) Appl. No.: 17/106,659

(22) Filed: Nov. 30, 2020

(65) Prior Publication Data

US 2022/0168764 A1 Jun. 2, 2022

(51) Int. Cl.

| | |
|---|---|
| ***B05B 11/00*** | (2023.01) |
| ***B05B 15/65*** | (2018.01) |
| ***B05B 7/12*** | (2006.01) |
| ***B05B 1/30*** | (2006.01) |

(52) U.S. Cl.

CPC ..... *B05B 11/0089* (2013.01); *B05B 1/3046* (2013.01); *B05B 7/12* (2013.01); *B05B 15/65* (2018.02)

(58) Field of Classification Search

CPC ... B05B 11/0089; B05B 1/3046; B05B 1/304; B05B 7/12; B05B 15/65; B65D 83/207

USPC ... 222/321, 1, 522, 394, 398, 399, 135–137, 222/469, 470, 472

See application file for complete search history.

(56) References Cited

U.S. PATENT DOCUMENTS

| | | | | |
|---|---|---|---|---|
| 5,683,544 | A * | 11/1997 | Kopp | B65D 83/207 222/569 |
| 5,887,756 | A * | 3/1999 | Brown | B05B 12/002 222/394 |
| 6,837,398 | B2 | 1/2005 | Rueschhoff et al. | |
| 8,701,945 | B2 | 4/2014 | Hoagland et al. | |
| 8,720,747 | B2 | 5/2014 | Hoagland et al. | |
| 10,364,092 | B2 * | 7/2019 | Schroer | B65D 83/207 |

* cited by examiner

*Primary Examiner* — Lien M Ngo

(74) *Attorney, Agent, or Firm* — Crawford Maunu PLLC

(57) ABSTRACT

Aspects of the disclosure are directed to a spray gun apparatus having a casing with a nozzle. A rod extends within the casing and has an end portion with openings therein, for dispensing material. The rod operates with the casing to move relative to one another, for selectively dispensing the material. When the nozzle is positioned such that it is offset from the end portion of the rod, fluid material is allowed to flow out of the rod and is dispensed through the nozzle. When the end portion of the rod is positioned to seal the nozzle opening (e.g., via relative movement of the casing and rod), the fluid material is prevented from being dispensed through the nozzle. In certain implementations, an adapter interface is operable for coupling to an aerosol container having the material to be dispensed, and includes a conduit coupled to the rod for supplying the material.

21 Claims, 7 Drawing Sheets

DISPENSING APPARATUS AND METHOD

BACKGROUND

A variety of types of fluids, foams and other materials are dispensed from pressurized containers, pumps or other sources to suit many applications. For instance, aerosols can be utilized for spraying fluid or foam from a spray can or other vessel. However, directing the spray from a can may be challenging, and manipulation of a can into a desirable spraying position can be difficult in certain environments.

Expanding foam is one type of material that can be challenging to properly dispense. For instance, such foam may often be desirably sprayed/dispensed into cavities or onto surfaces that are confined or otherwise difficult to reach. If expanding foam must be dispensed directly from a can, the size and shape of the can may prevent dispensing of the foam to a desired location. Furthermore, it can be important to seal any foam that has not been dispensed to prevent further expansion/leakage, or undesirable curing.

These and other matters have presented challenges to dispensing liquids, foams and other materials, for a variety of applications.

SUMMARY

Various example embodiments are directed to a dispensing apparatus, its application and their manufacture, as may be implemented for addressing challenges including those noted above. Such embodiments may be useful for dispensing fluid materials at a position that is remote from a related material supply. Particular embodiments are directed to a remote spray gun apparatus configured to couple to a spray can, and having a body/trigger mechanism that facilitates dispensing of expandable foam from the spray can, at a remote location. The apparatus may include a flexible connection to the spray can that allows (generally) independent positioning of a nozzle relative to the spray can, which may facilitate access to cavities, surfaces or any location at which foam is to be dispensed.

Aspects of the disclosure are directed to an apparatus including a casing having a nozzle with an opening therein, and a rod extending within the casing and having an end portion with openings therein. The rod is configured and arranged with the casing to, in a dispensing state in which the nozzle is offset from the end portion of the rod, dispense fluid material through the rod and the nozzle via the openings in the end portion of the rod. The rod is further configured and arranged with the casing to prevent the fluid material from being dispensed through the rod and the nozzle in a closed state in which the end portion of the rod seals the nozzle opening.

Another embodiment is directed to an apparatus comprising a rod, a casing configured to move relative to the rod, a trigger configured to move the casing in response to force applied to the trigger, and a nozzle coupled to the casing. The rod extends within the casing and is configured and arranged with the casing and the nozzle to operate in dispensing and closed states as follows. In the dispensing state, fluid material is dispensed through the nozzle in response to movement of the casing relative to the rod that provides a gap between the rod and nozzle and therein permits flow of the fluid material. In the closed state, the rod seals the nozzle in response to movement of the casing relative to the rod (e.g., engaging an outer surface of the rod with an inner surface of the nozzle).

Certain embodiments further include a coupling mechanism operable to couple with an apparatus as noted above (or as part of such an apparatus), and to a material supply such as an aerosol can or fluid pump. The coupling mechanism may include a tube or other fluid conduit that conveys fluid material between the coupling mechanism and the dispensing apparatus. The coupling mechanism may include a check valve or other type of valve that prevents backflow of fluid from upon detachment from the material supply.

The above discussion/summary is not intended to describe each embodiment or every implementation of the present disclosure. The figures and detailed description that follow also exemplify various embodiments.

BRIEF DESCRIPTION OF FIGURES

Various example embodiments may be more completely understood in consideration of the following detailed description and in connection with the accompanying drawings, in which.

Figure 1:
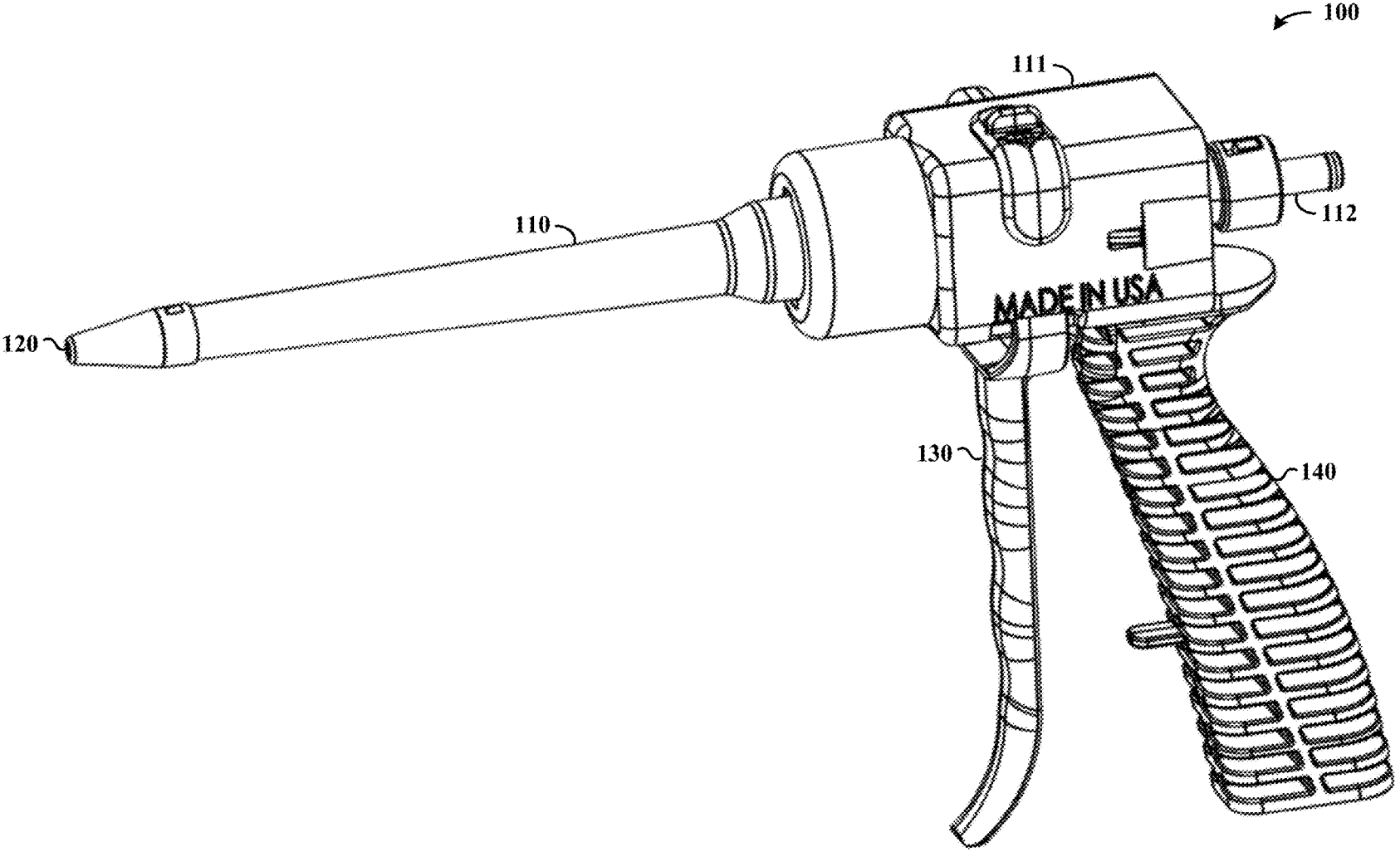
FIG. 1 shows an oblique view of a remote gun dispenser, as may be implemented in accordance with one or more embodiments.

While various embodiments discussed herein are amenable to modifications and alternative forms, aspects thereof have been shown by way of example in the drawings and will be described in detail. It should be understood, however, that the intention is not to limit the invention to the particular embodiments described. On the contrary, the intention is to cover all modifications, equivalents, and alternatives falling within the scope of the disclosure including aspects defined in the claims. In addition, the term "example" as may be used throughout this application is by way of illustration, and not limitation.

DETAILED DESCRIPTION

Aspects of the present disclosure are believed to be applicable to a variety of different types of articles of manufacture, apparatuses, systems and methods involving a dispensing apparatus. In certain implementations, aspects of the present disclosure have been shown to be beneficial when used in the context of dispensing fluid/foam from a pressurized vessel, via a hand-held spray gun. While not necessarily so limited, various aspects may be appreciated through a discussion of examples using such exemplary contexts.

As may be implemented in accordance with various example embodiments, a dispensing apparatus includes a remote gun and a fluid coupler connected by a fluid channel.

The fluid coupler is configured to couple to a vessel such as an aerosol can, and the fluid channel is configured to flow material from the vessel to the remote gun. The fluid coupler may include threads or other fastening components that operate to form a seal with the vessel. The fluid coupler may also include a valve, such as a ball or check valve that prevents backflow of material from the remote gun and fluid channel out of the fluid coupler. The remote gun has a trigger mechanism that, when actuated or otherwise positioned in an open state, flows the material dispensed from the vessel (e.g., via a propellant or pump) out of a nozzle. When released or otherwise positioned in a closed state, the trigger mechanism facilitates formation of a seal that prevents the material from being dispensed out of the nozzle. For instance, the trigger mechanism may cause relative movement between a rod and the nozzle and/or body of the remote gun that opens/releases or closes/seals an aperture via which the material may be selectively dispensed. The seal may be operable to mitigate or prevent further exposure of material in the remote gun to atmosphere (e.g., by providing a hermetic seal).

Certain embodiments are directed to a dispensing apparatus as may be utilized, for example, in connection with the remote gun noted above. The apparatus includes a rod and a casing that move relative to one another for dispensing fluid through a nozzle. The nozzle may be implemented as part of the casing, for instance as a removable nozzle coupled to the casing or integrated with the casing. The rod extends within the casing and has an end portion with openings therein for passing fluid to the nozzle. When the nozzle is offset from the end portion of the rod, the rod and casing operate to dispense fluid material through the rod and the nozzle, via the openings in the end portion of the rod. When the end portion of the rod seals the nozzle opening, fluid material is prevented from being dispensed through the rod and the nozzle.

Movement of the rod relative to the casing may be effected in a variety of manners, for example by moving one or both of the rod and casing, effecting movement with a lever or trigger type input, or automated actuation such as via use of a solenoid or other actuator. For instance, actuating between such dispensing/open and closed/sealed states may be effected in response to trigger mechanism actuation, in which a trigger moves the nozzle/casing away from an end of the rod to provide a gap between the rod and nozzle/casing for dispensing material. The trigger mechanism may further operate to move the nozzle/casing toward the rod in response to releasing of the trigger mechanism. For example, a spring return may cause the rod to seal the nozzle upon release of the trigger, such as by engaging an outer surface of an end portion of the rod with an inner surface of the nozzle. Further, partial actuation of the trigger may facilitate control of a rate at which material is being dispensed, by controlling an aperture size defined by the nozzle and rod. Accordingly, the trigger mechanism may move the casing away from the rod, move the rod away from the casing, or move both the rod and casing away from one another for dispensing material.

In certain embodiments, the apparatus includes the trigger and a spring that operate to move the casing relative to the rod to disengage the casing from the rod and therein provide a gap, in response to force applied to the trigger. In response to the force applied to the trigger being relieved, the trigger and spring operate to move the casing relative to the rod and therein engage the outer surface of an end portion of the rod with an inner surface of the nozzle.

In some embodiments, the rod is operable with the casing, nozzle and trigger to dispense an amount of material that may be adjusted based the degree to which the trigger is pulled. For instance, the nozzle and rod may be configured with corresponding interface surfaces that set an opening size of the nozzle and, therein, may be utilized to set a bead size or other spray size.

Another embodiment is directed to an apparatus having a rod, a casing that moves relative to the rod, a nozzle that is part of and/or otherwise coupled to the casing, and a trigger that moves the casing when force is applied thereto. The rod is operable to extend to and/or into the nozzle. The rod, casing and nozzle operate in dispensing and closed states as follows. In the dispensing state, fluid material is dispensed through the nozzle in response to movement of the casing relative to the rod that provides a gap between the rod and nozzle and therein permits flow of the fluid material. In the closed state, the rod seals the nozzle in response to movement of the casing relative to the rod (e.g., engaging an outer surface of the rod with an inner surface of the nozzle and/or casing).

As noted above, the engaging of the rod and nozzle/casing may be further configured to facilitate control of an amount of material being dispensed based on a degree to which the trigger is moved. For instance, the trigger may be operable to move the casing relative to the rod in the dispensing state, in response to the application of force that causes movement of the trigger. The amount of force applied may be controlled to set the amount of material being dispensed. As such, the trigger may be further operated to, in the dispensing state, control a bead size of the fluid material dispensed through the nozzle based on a distance at which the trigger is actuated.

In some embodiments, the rod includes a hollow inner portion to convey the fluid material to the nozzle and an opening configured to flow the fluid material to into the nozzle in the dispensing state, with the rod being operable to engage the opening with the nozzle for sealing the opening in the closed state.

In some embodiments, a spring is operable to apply a spring force that maintains the nozzle and rod in the closed state. The trigger may thus include a lever configured to, in response to the trigger being squeezed (e.g., relative to a grip), apply a force to the casing that counters the spring force and moves the casing relative to the rod in the dispensing state.

The rod may be implemented in a variety of manners. In some implementations, the rod includes a hollow inner portion that conveys fluid material to the nozzle, and an end portion that flows the fluid material into the nozzle in the dispensing state. In the closed state, the rod engages with and seals the nozzle. The end portion may have an outer surface shaped and configured to seal the nozzle by engaging with an inner surface of the nozzle and therein seal the end portion of the rod to the nozzle and preventing the fluid material from flowing out of the nozzle. The outer surface may further include a cylindrical end portion that is shaped and configured to seal the nozzle by engaging with a cylindrical inner surface of the nozzle for sealing the nozzle. Further, the outer surface may include a tapered exterior portion extending from the cylindrical end portion and having an opening therein to flow the fluid material into the nozzle. The inner surface of the nozzle may further include a tapered portion extending from the cylindrical inner surface of the nozzle and aligned with the tapered exterior portion.

In a particular implementation, the outer surface includes a cylindrical end portion that is shaped and configured to seal the nozzle by engaging with a cylindrical inner surface of the nozzle for sealing the nozzle, and a tapered portion extending from the cylindrical end portion. The inner surface of the nozzle further includes a tapered portion extending from the cylindrical inner surface that, in the closed state, aligns with the tapered portion of the outer surface, for instance by engaging with and sealing openings in the tapered portion.

In some embodiments, an interior portion of the nozzle and an exterior portion of the end portion are tapered, and an outer surface of the tapered exterior portion of the end portion of the rod is configured to, in the closed state, align with an inner surface the tapered interior portion of the nozzle. The tapered exterior portion may have an opening to flow the fluid material into the nozzle.

The trigger mechanism may be implemented in a variety of manners. In some embodiments, the trigger includes a pivot mechanism that is responsive to the application of force by pivoting about the pivot mechanism. This facilitates application of force from the trigger to the casing that causes longitudinal movement of the casing relative to a length of the rod.

Certain embodiments are directed to an adapter interface and conduit for coupling to and flowing material from a container having the material therein. The conduit may be coupled to the adapter interface and a rod as noted above, with material being provided from the container to the rod in response to actuation of the trigger in a dispensing state. The adapter interface may include a check valve that prevents backflow of material from the conduit via the adapter interface, when the adapter interface is not coupled to the container.

Turning now to the figures, FIG. 1 shows an oblique view of a remote gun dispenser 100, as may be implemented in accordance with one or more embodiments. A casing 110 has a nozzle 120 and encloses a rod structure. A trigger mechanism 130, including componentry within housing 111, is operable to move the casing 110 relative to the enclosed rod therein. This movement may cause the nozzle 120 to selectively engage and disengage with the rod, which respectively seals and opens the nozzle for dispensing material supplied via inlet 112 through the nozzle. Grip 140 provides a manner in which to grip the remote gun dispenser and facilitates actuation of the trigger mechanism (e.g., squeezing).

Figure 2:
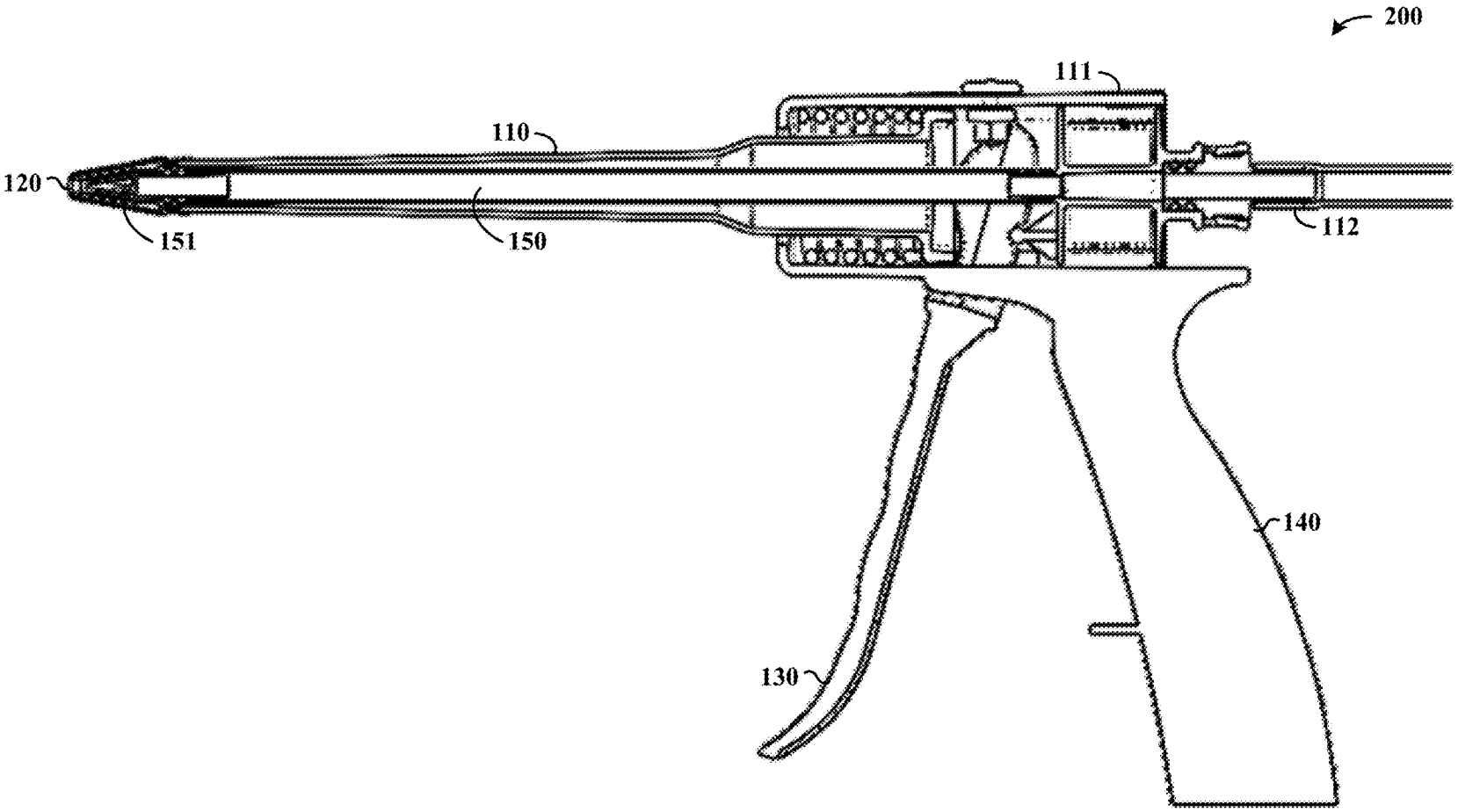
FIG. 2 shows a cross-sectional view of a remote gun dispenser, as may be implemented in accordance with one or more embodiments.
Figure 3:
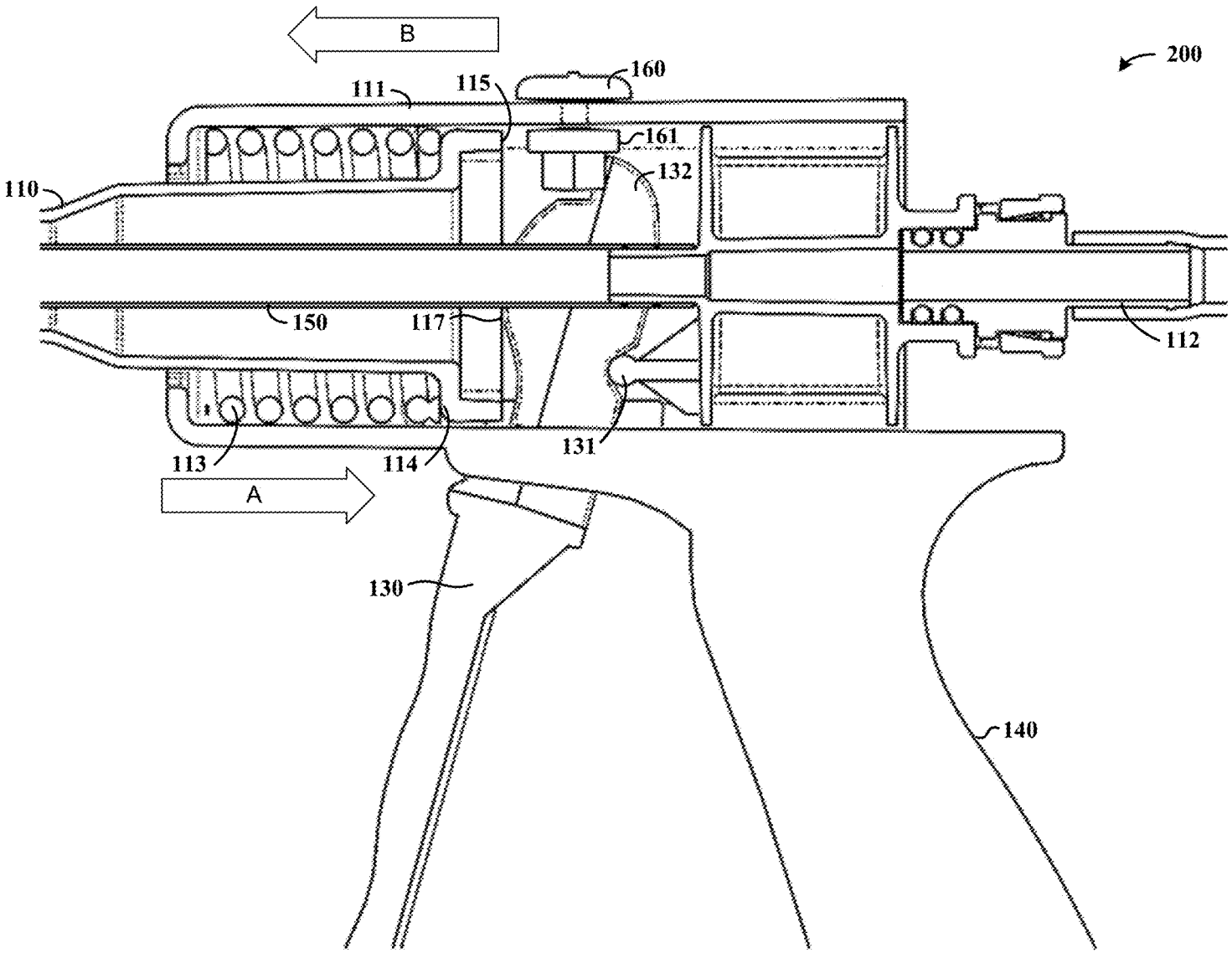
FIG. 3 shows a cross-sectional view of the remote gun dispenser shown in FIG. 2, as may be implemented in accordance with one or more embodiments.

FIGS. 2 and 3 show cross-sectional views of a remote gun dispenser 200 as may be implemented in accordance with one or more embodiments. Referring to FIG. 1, while a variety of internal componentry for the trigger mechanism 130 and its interaction with the casing 110 may be utilized, the componentry shown in FIGS. 2 and 3 may be implemented as shown therein. Accordingly, FIGS. 2 and 3 are represented with similar numbering by way of example.

Referring to FIG. 2, casing 110 and nozzle 120 are shown enclosing a rod 150 having an end 151 that dispenses material and further operates to seal the nozzle 120. Referring to FIG. 3, housing 111 encloses a spring 113 as well as a pivot structure 131 and lever end 132 of the trigger mechanism 130, as well as a portion of the casing 110. The spring 113 operates to apply force at interface 114 in a direction shown by arrow A. When the remote gun dispenser 200 is in a dispensing state and the trigger mechanism 130 is released, the spring 113 causes the casing 110 to move in the direction shown by arrow A to seal the nozzle 120.

For dispensing material, the lever end 132 of the trigger mechanism 130 is operable to pivot about the pivot structure 131 and engage with a back end 115 of the casing 110 at 117 to apply a force in the direction shown by arrow B. When this force is applied in a closed state and is sufficient to overcome the spring force in the direction noted by arrow A, the lever end 132 engages with the casing 110 at interface 117 and moves the casing 110 in the direction noted by Arrow B, therein separating the nozzle 120 from the end 151 of the rod. This allows material supplied via inlet 112 to flow through the rod 150, out end 151 and through the nozzle 120. The inlet 112 may, for example, be part of the rod 150 or coupled to the rod in a variety of manners. A stop 160 may further be implemented to hold the trigger mechanism 130 in locked position via engaging portion 161 to ensure that material is not dispensed.

Figure 4:
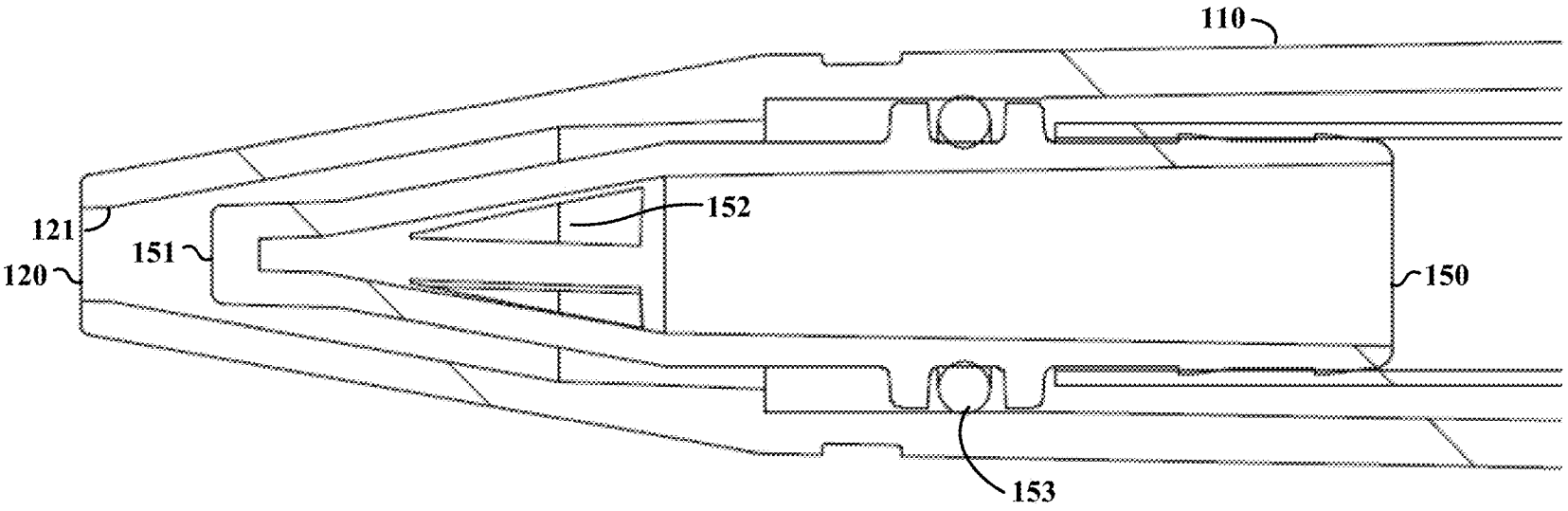
FIG. 4 shows a section view of a nozzle and rod in an open position, as may be implemented in accordance with one or more embodiments.
Figure 5:
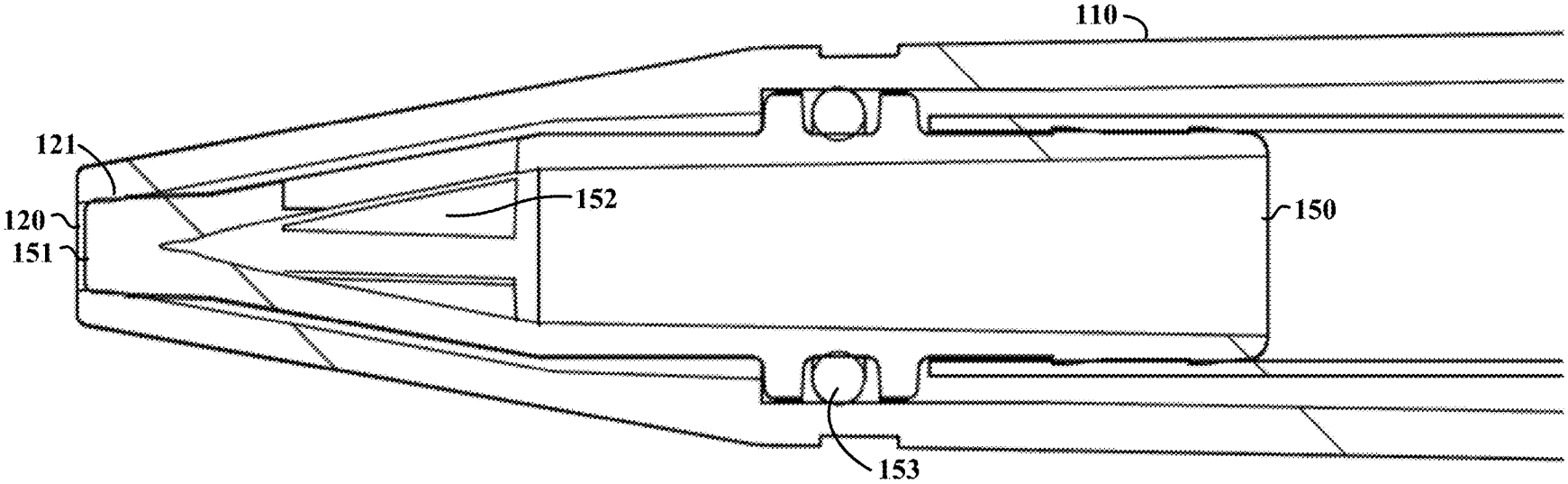
FIG. 5 shows a section view of the nozzle and rod of FIG. 4 in a closed position, as may be implemented in accordance with one or more embodiments.

FIGS. 4 and 5 show a section view of a nozzle 120 and rod 150 respectively in open and closed positions, as may be implemented in accordance with one or more embodiments. As with the discussion above in FIGS. 2 and 3, the componentry shown in FIGS. 4 and 5 may be implemented in embodiments involving one or more of FIGS. 1-3. Accordingly, similar numbering is utilized.

Beginning with FIG. 4, nozzle 120 is shown separated from end 151 of rod 150. In this position, for example corresponding to trigger mechanism 130 engaging with the back end 115 of casing 110, the casing 110 (and nozzle 120) are moved away from the end 151 of the rod, leaving a gap between the end of the rod and an inner surface 121 of the nozzle. This allows material to flow through and exit the rod at openings 152, pass by the end 151 and through the nozzle 120. By way of example, the rod 150 is shown with an O-ring type structure 153 that seals the nozzle end of the casing 110, preventing material from flowing into other areas of the casing. The O-ring type structure 153 may also facilitate movement of the casing 110 along the rod into the open position, and may be implemented with sliding or bearing-type components as well.

Referring to FIG. 5, the rod 150 and casing 110 are positioned to seal nozzle 120, with the end 151 of the rod engaging with the inner surface 121 of the nozzle. For instance, from an open position as in FIG. 4 and with pressure on the trigger mechanism 130 released, spring 113 may actuate the casing 110 along the rod (e.g., via O-ring type structure 153), moving the nozzle 120 to engage with the end 151 of the rod as shown. In this position, material is prevented from flowing out of the openings 152, and the spring 113 acts against opening of the nozzle. Stop 160 may further lock the trigger mechanism 130 in place to maintain this closed position.

Figure 6:
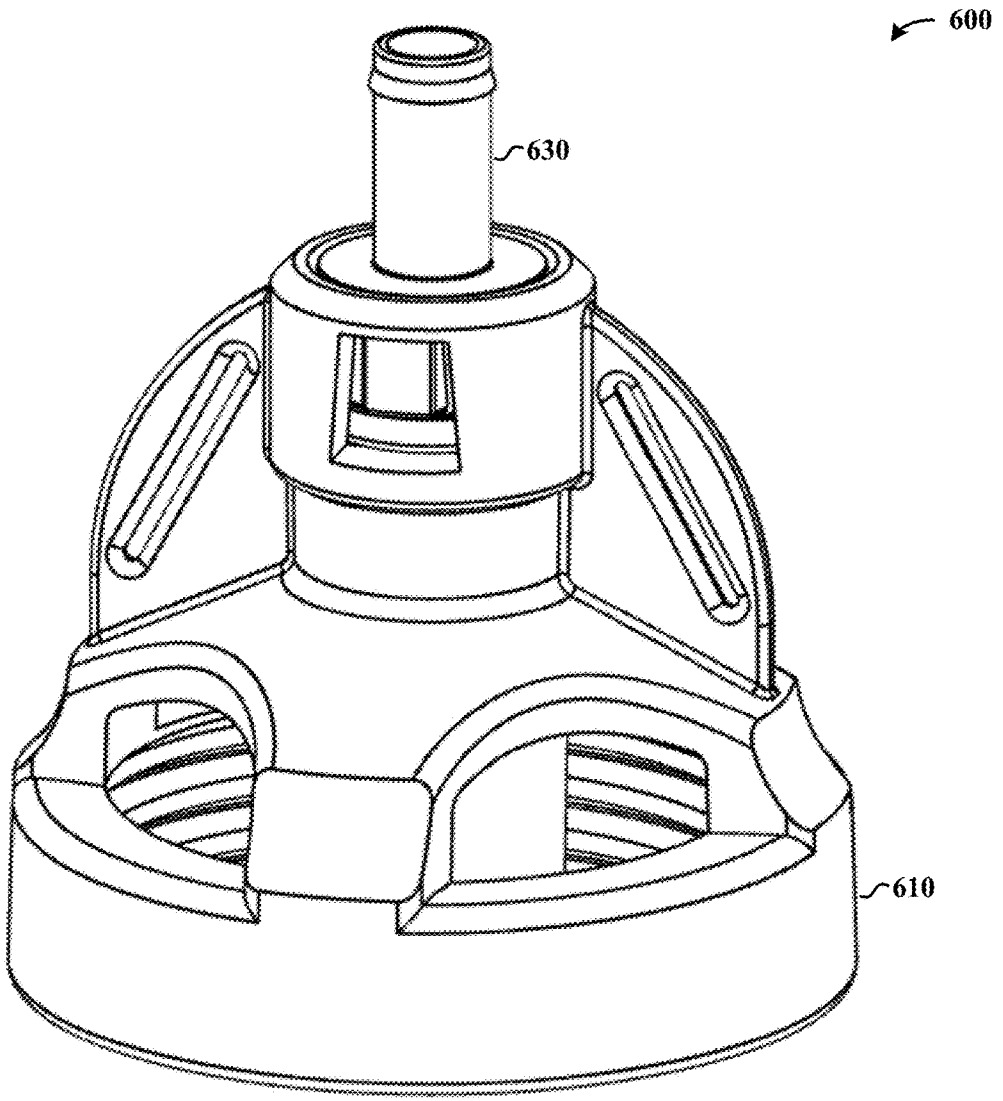
FIG. 6 shows a coupler, as may be implemented in accordance with one or more embodiments.
Figure 7:
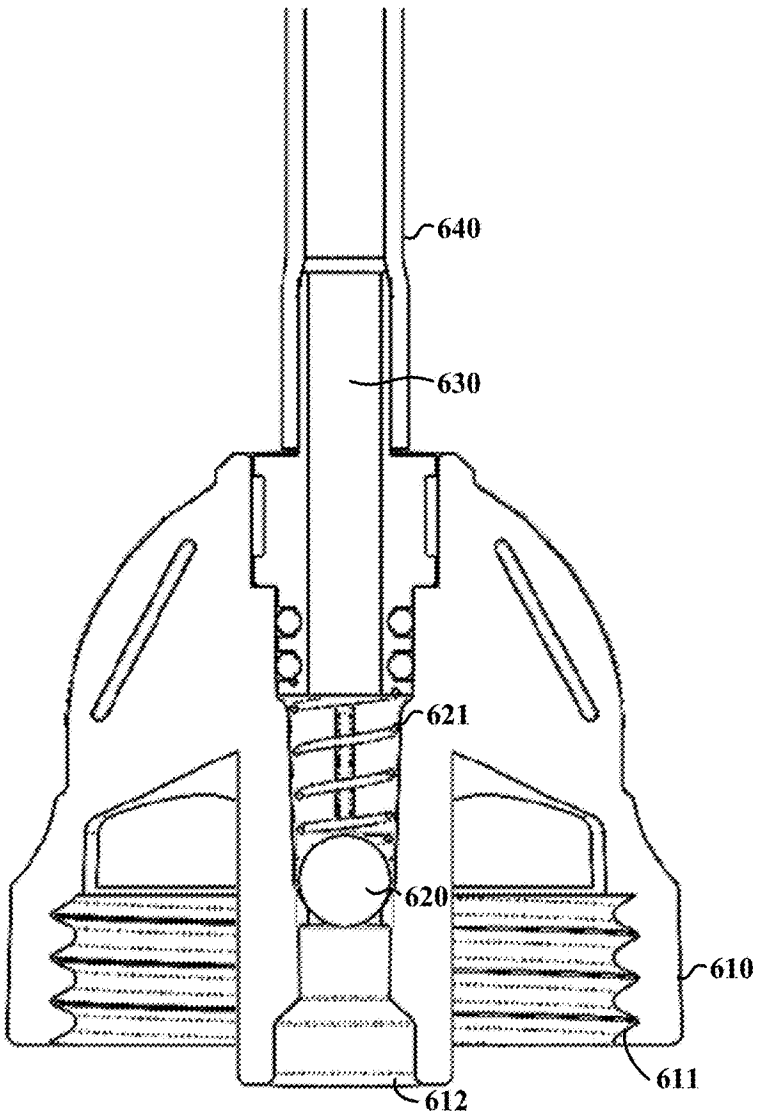
FIG. 7 shows a cross-sectional view of the coupler in FIG. 6, as may be implemented in accordance with one or more embodiments.

FIGS. 6 and 7 respectively show oblique and cross-sectional views of a coupler 600, as may be implemented in accordance with one or more embodiments. The coupler 600 includes an engagement portion 610 that may have threads 611 operable for engaging to a material supply, such as an aerosol can. Other types of engagement may be utilized in addition to or in alternative to the threads, such as a latch. An outlet 630 is configured to couple to a fluid conduit 640 (e.g., tubing or hose), which may for example be connected to the inlet 112 as shown in FIG. 3.

When engaged (e.g., with an aerosol can), the coupler 600 passes material received via inlet 612 to the outlet 630 and fluid conduit 640. A valve such as a check valve may be implemented to prevent backflow of material from the fluid conduit 640 and out of the inlet 612 when the coupler 600 is disengaged from a material source. For instance, a check valve having a ball 620 and spring 621 operable to press the ball against the inlet 612 may operate to prevent backflow while also permitting material flow (e.g., propelled by an aerosol or pumped) in a dispensing state. This valve may further operate to maintain a seal so that material in the coupler 600 and fluid conduit 640 is not further exposed air.

Based upon the above discussion and illustrations, those skilled in the art will readily recognize that various modifications and changes may be made to the various embodiments without strictly following the exemplary embodiments and applications illustrated and described herein. For example, a variety of different types of materials may be dispensed, in addition to those mentioned. Further, various other trigger mechanisms may be implemented with similar effect, such as by moving the rod relative to the casing. In addition, similar spring and lever components shown in the figures to open the shown nozzle by moving the rod relative to the casing, for certain embodiments. Such modifications do not depart from the true spirit and scope of various aspects of the invention, including aspects set forth in the claims.

What is claimed is:

1. An apparatus comprising:

a rod;

a casing configured to move relative to the rod;

a trigger configured to move the casing in response to force applied to the trigger; and a nozzle coupled to the casing with the rod extending within the casing, the nozzle being configured and arranged with the casing and the rod to:

in a dispensing state, dispense fluid material through the nozzle in response to movement of the casing relative to the rod that provides a gap between the rod and nozzle and initiates flow of the fluid material into the rod and to the nozzle; and in a closed state, seal the nozzle with the rod in response to movement of the casing relative to the rod.

2. The apparatus of claim 1, wherein the rod includes:

a hollow inner portion configured to convey the fluid material to the nozzle; and an end portion configured to:

in the dispensing state, flow the fluid material into the nozzle; and in the closed state, engage with and seal the nozzle.

3. The apparatus of claim 2, wherein the end portion of the rod has an outer surface shaped and configured to seal the nozzle by engaging with an inner surface of the nozzle and therein seal the end portion of the rod to the nozzle and preventing the fluid material from flowing out of the nozzle.

4. The apparatus of claim 3, wherein the outer surface includes a cylindrical end portion that is shaped and configured to seal the nozzle by engaging with a cylindrical inner surface of the nozzle for sealing the nozzle.

5. The apparatus of claim 4, wherein the outer surface includes a tapered exterior portion extending from the cylindrical end portion and having an opening therein to flow the fluid material into the nozzle.

6. The apparatus of claim 5, wherein the inner surface of the nozzle includes a tapered portion extending from the cylindrical inner surface of the nozzle and aligned with the tapered exterior portion, in the closed state.

7. The apparatus of claim 3, wherein:

the outer surface includes a cylindrical end portion that is shaped and configured to seal the nozzle by engaging with a cylindrical inner surface of the nozzle for sealing the nozzle; and the outer surface includes a tapered portion extending from the cylindrical end portion; and the inner surface of the nozzle includes a tapered portion extending from the cylindrical inner surface that, in the closed state, aligns with the tapered portion of the outer surface.

8. The apparatus of claim 2, wherein:

an interior portion of the nozzle and an exterior portion of the end portion are tapered; and an outer surface of the tapered exterior portion of the end portion of the rod is configured to, in the closed state, align with an inner surface the tapered interior portion of the nozzle.

9. The apparatus of claim 8, wherein the outer surface of the tapered exterior portion has an opening to flow the fluid material into the nozzle.

10. The apparatus of claim 2, wherein the trigger is configured to move the casing relative to the rod in the dispensing state, in response to the application of force that causes movement of the trigger.

11. The apparatus of claim 1, wherein the rod includes a hollow inner portion configured to convey the fluid material to the nozzle and an opening configured to flow the fluid material to into the nozzle in the dispensing state, the rod being configured to engage the opening with the nozzle for sealing the opening in the closed state.

12. The apparatus of claim 1, further including a spring configured to apply a spring force that maintains the nozzle and rod in the closed state, wherein the trigger includes a lever configured to, in response to the trigger being squeezed, apply a force to the casing that counters the spring force and moves the casing relative to the rod in the dispensing state.

13. The apparatus of claim 1, wherein the nozzle is part of the casing.

14. The apparatus of claim 1, further including a grip fixed to the rod, wherein the trigger is configured to transition the apparatus from the closed state in which pressurized fluid is presented to an inlet of the rod, to the dispensing state in which the pressurized fluid is flowed into the rod in response to the application of force that causes movement of the trigger toward the trigger while maintaining the rod in a fixed position in both the closed state and the dispensing state.

15. The apparatus of claim 14, wherein the trigger includes a pivot mechanism configured to, in response to the application of the force that causes the trigger to pivot about the pivot mechanism, facilitate application of force from the trigger to the casing that causes longitudinal movement of the casing relative to a length of the rod.

16. The apparatus of claim 1, further including:

an adapter interface configured to couple to a container having the fluid material pressurized therein and to provide the pressurized fluid to an inlet of the rod in both the closed state and the dispensing state; and a conduit coupled to the adapter interface and the rod, the adapter interface and conduit being configured and arranged to supply the fluid material from the container to the rod in response to actuation of the trigger in the dispensing state with the rod remaining fixed in position relative to the conduit, therein causing the pressurized fluid provided to the inlet to flow through the rod and nozzle.

17. The apparatus of claim 16, wherein the adapter interface includes a check valve configured to prevent backflow of material from the conduit via the adapter interface, when the adapter interface is not coupled to the container.

18. The apparatus of claim 1, wherein the trigger is configured and arranged with the nozzle to, in the dispensing state, control a bead size of the fluid material dispensed through the nozzle based on a distance at which the trigger is actuated.

19. An apparatus comprising:

a casing having a nozzle with an opening therein;

a rod extending within the casing and having an end portion with openings therein, the rod being configured and arranged with the casing to, with the rod fixed in place and with an inlet to the rod coupled to receive pressurized fluid material:

dispense the pressurized fluid material through the rod and the nozzle via the openings in the end portion of the rod in a dispensing state in which the nozzle is offset from the end portion of the rod and in which the offset causes the pressurized fluid material to flow into the rod while the rod remains fixed in place; and with the rod remaining fixed in place, prevent the pressurized fluid material from flowing into the rod and being dispensed through the rod and the nozzle in a closed state in which the end portion of the rod seals the nozzle opening and the inlet remains coupled to receive the pressurized fluid.

20. The apparatus of claim 19, wherein the rod is configured and arranged with the casing to switch between the dispensing state and the closed state by moving the casing relative to the rod, including:

moving the casing and rod to provide a gap between the rod and the nozzle, therein allowing the fluid material to flow through the openings and into the nozzle; and moving the casing and rod to engage an outer surface of the end portion with an inner surface of the nozzle and therein seal and prevent the nozzle from dispensing the fluid material.

21. The apparatus of claim 20, further including a trigger and a spring configured to:

in response to force applied to the trigger, move the casing relative to the rod to disengage the casing from the rod and therein provide the gap; and in response to the force applied to the trigger being relieved, move the casing relative to the rod and therein engage the outer surface of the end portion of the rod with the inner surface of the nozzle.

* * * * *